US005360535A

United States Patent [19]

Liu et al.

[11] Patent Number: 5,360,535

[45] Date of Patent: Nov. 1, 1994

[54] EBULLATED BED PROCESS WITH RECYCLE EDUCTOR

[75] Inventors: Edward K. Liu; Doyun Kim; Ting Y. Chan, all of Houston, Tex.

[73] Assignee: Texaco Inc., White Plains, N.Y.

[21] Appl. No.: 115,065

[22] Filed: Sep. 2, 1993

[51] Int. Cl.[5] ..... C10G 49/16; C10G 49/22

[52] U.S. Cl. ..... 208/157; 208/158; 208/103; 208/104; 208/105; 208/102

[58] Field of Search ..... 208/100, 101, 102, 103, 208/104, 105, 143, 153, 157, 408, 351, 361, 158

[56] References Cited

U.S. PATENT DOCUMENTS

| | | | |
|---|---|---|---|
| 3,617,524 | 11/1971 | Conn | 208/157 |
| 4,124,496 | 11/1978 | Cummings | 208/361 |
| 4,410,414 | 10/1983 | Briley | 208/408 |
| 4,925,573 | 5/1990 | Yorlow | 208/100 |

OTHER PUBLICATIONS

Ahmed, Tarek, *Hydrocarbon Phase Behavior,* Contributions in Petroleum Geology & Engineering, v. 7, pp. 275–281, Gulf Publishing Co. (1989).

*Primary Examiner*—Asok Pal
*Assistant Examiner*—Bekir L. Yildirim
*Attorney, Agent, or Firm*—James L. Bailey; Kenneth R. Priem; Richard A. Morgan

[57] ABSTRACT

In an ebullated bed process reactor effluent is subjected to high pressure followed by intermediate flash separation. An ebullation liquid is formed by educting high pressure flash separation liquid into an intermediate flash separation liquid. The ebullation liquid is recycled to the reactor to expand the catalyst bed to 110 vol % to 200 vol % of a settled catalyst bed volume. As a result of recycle pressure balance is advantageously maintained. Carry over catalyst and catalyst fines are recycled to the reactor and kept out of downstream equipment.

5 Claims, 1 Drawing Sheet

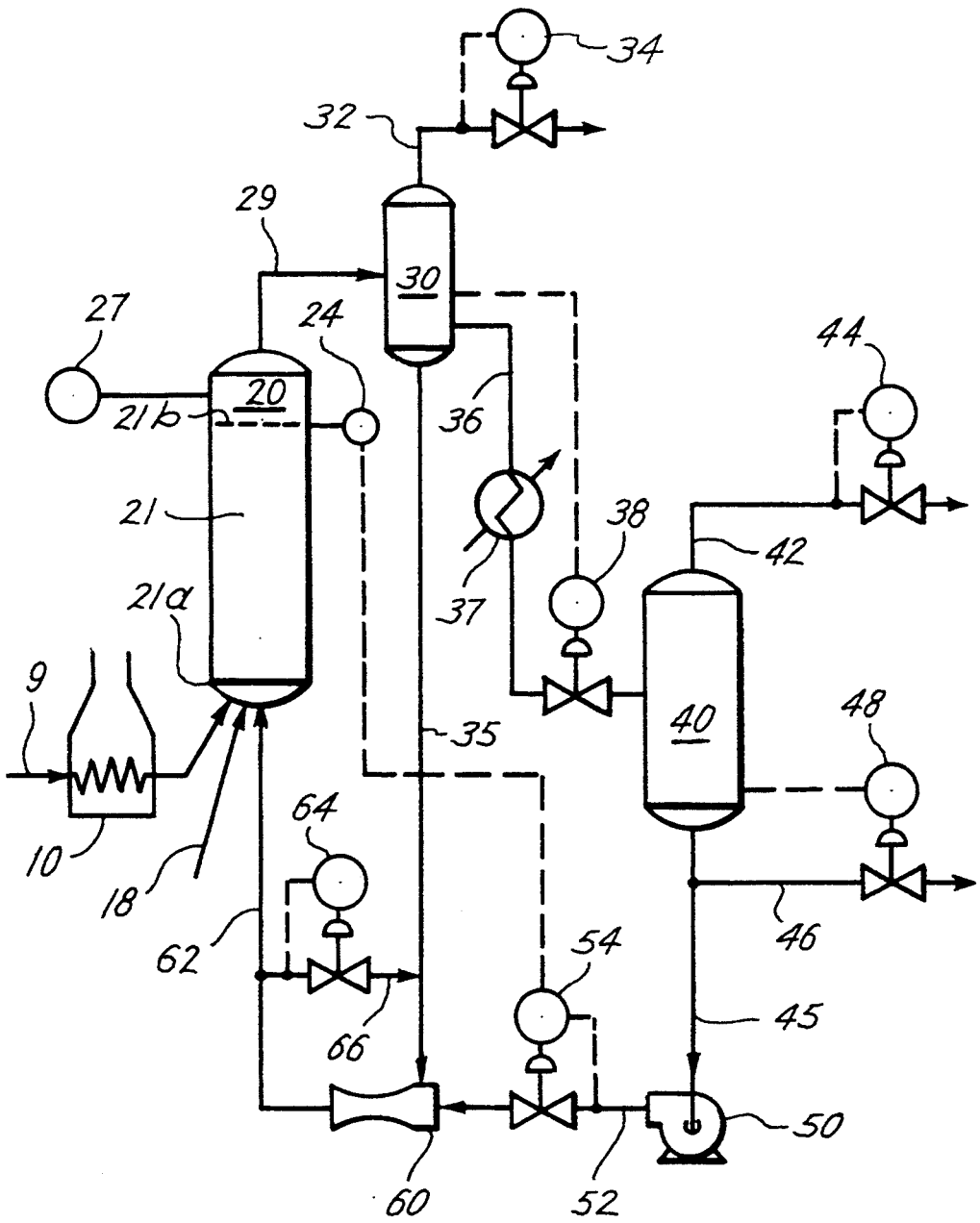
34
32
29
30
27
24
44
20
21b
36
21
38
42
37
21a
9
35
40
48
64
10
18
46
62
54
66
45
50
60
52

EBULLATED BED PROCESS WITH RECYCLE EDUCTOR

BACKGROUND OF THE INVENTION

1. Field Of The Invention

The invention relates to an ebullated bed process for the liquid phase hydroprocessing of a hydrocarbon feedstock. The invention also relates to a recycle system with a liquid/liquid eductor for ebullating a catalyst bed.

2. Description of Other Related Methods in the Field

The ebullated bed process comprises the passing of concurrently flowing streams of liquids or slurries of liquids and solids and gas upwardly through a vertically elongated cylindrical vessel containing a catalyst bed. The catalyst in the bed is maintained in random motion in the liquid and has a gross volume dispersed through the liquid greater than the volume of the catalyst when stationary. This technology has been used commercially in the upgrading of heavy liquid hydrocarbons or converting coal to synthetic oils.

The process is generally described in U.S. Pat. No. 25,770 to Johanson incorporated herein by reference. A mixture of hydrocarbon liquid and hydrogen is passed upwardly through a bed of catalyst particles at a rate such that the particles are forced into random motion as the liquid and gas flow upwardly through the bed. The random catalyst motion is controlled by recycle liquid flow so that at steady state, the bulk of the catalyst does not rise above a definable level in the reactor. Vapors along with the liquid which is being hydrogenated are removed at the upper portion of the reactor.

In an ebullated bed process the substantial amounts of hydrogen gas and light hydrocarbon vapors rise through the reaction zone into the catalyst free zone. Liquid from the catalyst free zone is both recycled to the bottom of the reactor to ebullate the catalyst bed and removed from the reactor as product. Vapor is separated from the liquid recycle stream before being passed through the recycle conduit to the recycle pump suction. The recycle pump (ebullation pump) maintains the expansion (ebullation) and random motion of catalyst particles at a constant and stable level by recycling liquid to the bottom of the reactor. The recycle pump for this service has a high suction pressure but a head of only 10 to 100 psi, typically 50 psi. Such pumps are commercially available and command a premium price. Because of the high suction pressure service, the support facilities for these pumps, e.g., high pressure seal oil system and variable speed drive system require frequent and expensive maintenance.

Reactors employed in a catalytic hydrogenation process with an ebullated bed of catalyst particles are designed with a central vertical recycle conduit which serves as the downcomer for recycling liquid from the catalyst free zone above the ebullated catalyst bed to the suction of a recycle pump to recirculate the liquid through the catalytic reaction zone. The recycling of liquid from the upper portion of the reactor serves to ebullate the catalyst bed, maintain temperature uniformity through the reactor and stabilize the catalyst bed.

U.S. Pat. No. 4,684,456 to R. P. Van Driesen et al. teaches the control of catalyst bed expansion in an expanded bed reactor. In the process, the expansion of the bed is controlled by changing the reactor recycle pump speed. The bed is provided with high and low level bed detectors and an additional detector for determining abnormally high bed (interface) level. The interface level is detected by means of a density detector comprising a radiation source at an interior point within the reactor and a detection source in the reactor wall. Raising or lowering the bed level changes the density between the radiation source and the radiation detector. The vertical range of steady-state bed (interface) level as well as the highest and lowest steady-state interface level are design parameters.

U.S. Pat. No. 3,363,992 to M. C. Chervenak teaches a pumpless recycle system which is particularly adaptable to ebullating a catalyst bed. The recycle system relies on an elevated separator vessel to provide a liquid head in the absence of a recycle pump.

U.S. Pat. No. 3,617,524 to A. L. Conn teaches an ebullated bed process in which an eductor is used to inject a high velocity hydrogen stream into a hydrocarbon oil feedstock.

SUMMARY OF THE INVENTION

The invention is an ebullated bed hydroprocessing process in which a liquid hydrocarbon feedstock is passed upwardly from a lower end to an upper end of an expanded catalyst bed to produce a reactor effluent. The expanded catalyst bed comprises a reaction zone maintained at a reaction temperature and reaction pressure.

The reactor effluent is passed to a first flash separation zone where it is separated into a first separation vapor and first separation liquid. This separation is carried out at a first separation pressure 0 to 50 psi below the reaction pressure. First separation liquid is divided into a major portion and a minor portion.

The minor portion of the first separation liquid is passed to a second flash separation zone where it is separated into a second separation vapor and a second separation liquid. This separation is carried out at a second separation pressure 250 to 1230 psi below the first separation pressure.

The second separation liquid is pumped to a motive pressure 10 to 100 psi above the reaction pressure. The major portion of the first separation liquid is educted into the second separation liquid to form an ebullation liquid. The ebullation liquid is passed to the lower end of the expanded catalyst bed in an amount to expand the catalyst bed volume to 110 vol % to 200 vol % of the settled catalyst bed volume.

BRIEF DESCRIPTION OF TEE DRAWING

In the Drawing is a schematic view of the process.

DETAILED DESCRIPTION OF THE INVENTION

In order to demonstrate and provide a better understanding of the invention, reference is made to the Drawing.

Conventional feedstocks for the ebullated bed process include heavy and intermediate distillate fractions from crude petroleum which can be upgraded by hydroprocessing consisting of hydrocracking and hydrotreating.

Hydrocracking feedstocks for the ebullated bed process include petroleum residua such as petroleum atmospheric distillation bottoms, vacuum distillation bottoms, asphalter bottoms, shale oil, shale oil residues, tar sands, bitumen, coal derived hydrocarbons, hydrocarbon residues, lube extracts and mixtures thereof.

Hydrotreating feedstocks are intermediate petroleum distillates such as gasoline, naphtha, kerosene, diesel oil and mixtures thereof. Heavier petroleum distillates include gas oil, vacuum gas oil and mixtures thereof.

An ebullated bed process feedstock is flowed through line 9 and heated to 650° F. to 950° F. in fired heater 10. The heated feedstock is passed into ebullated bed reactor 20 along with heated hydrogen-containing gas via line 18. This hydrogen-containing gas typically is a mixture of recycled hydrogen from the process and fresh hydrogen.

The hydrogen-containing gas comprises at least 50 vol % hydrogen, preferably at least 85 vol % hydrogen. The hydrogen-containing gas enters the process via line 18 at a temperature of about 200° F. (93° C.) to 1500° F. (815° C.) and a pressure of at least 300 psia (20.4 atm) to 5000 psia (341 atm) provided by a hydrogen compressor and heaters (not shown) dedicated to this service. Reaction pressure is essentially the same as hydrogen pressure measured on reactor pressure indicator 27.

Reactor vessel 20 contains an expanded catalyst bed 21 of solid particulate catalyst extending from a support plate at lower end 21*a* to a catalyst level at upper end 21*b*. The catalyst level is measured by catalyst level indicator and controller 24. Hydroprocessing reaction conditions preferably include a temperature of 500° F. (260° C.) to 950° F. (510° C.), hydrogen partial pressure of 100 psia (6.8 atm) to 3000 psia (204 atm) and a liquid hourly space velocity (LHSV) within the range of 0.1 to 5.0 vol of feed/hour/reactor volume. Hydrotreating is most preferably carried out at a temperature of 700° F. (371° C.) to 850° F. (454° C.) and a reaction pressure of 300 psia (20.4 atm) to 1200 psia (82 atm). Hydrocracking is most preferably carried out at a temperature of 600° F. (315° C.) to 850° F. (454° C.) and reaction pressure of 800 psia (54.4 atm) to 2000 psia (136 atm). These particular hydrocracking and hydrotreating conditions are selected based on experience and it is understood that the full range of operating conditions is contemplated in optimizing the hydroprocessing of a particular feedstock.

Reactor 20 has provision for fresh catalyst addition and withdrawal of used catalyst (not shown).

Preferable ebullated bed hydroprocessing catalyst comprises active metals, for example Group VIB salts and Group VIIIB salts on an alumina support of 60 mesh to 270 mesh having an average pore diameter in the range of 80 to 120 Å and at least 50% of the pores having a pore diameter in the range of 65 to 150 Å. Alternatively, catalyst in the form of extrudates or spheres of ¼ inch to 1/32 inch diameter may be used. Group VIB salts include molybdenum salts or tungsten salts selected from the group consisting of molybdenum oxide, molybdenum sulfide, tungsten oxide, tungsten sulfide and mixtures thereof. Group VIIIB salts include a nickel salt or cobalt salt selected from the group consisting of nickel oxide, cobalt oxide, nickel sulfide, cobalt sulfide and mixtures thereof. The preferred active metal salt combinations are the commercially available nickel oxide-molybdenum oxide and the cobalt oxide-molybdenum oxide combinations on alumina support.

The reaction zone may comprise a single reactor or multiple reactors. Configurations comprising a single reactor or two or three reactors in series or in parallel are well-known in commercial practice. In the ebullated bed process it is understood there is one catalyst bed per rector. In the Drawing, ebullated bed 21 is representative of a single reactor or two or three reactors in series or in parallel which are all equivalent for purposes of this invention.

Hot reactor effluent in line 29 is subjected to high and intermediate pressure flash separation. The pressure vessels for carrying out these unit operations are represented as high pressure flash drum 30 and intermediate pressure flash drum 40.

The mixed phase reactor effluent is separated at a first separation pressure approximately equal to reaction pressure generally 0 to 50 psi below the reaction pressure, and with 0.5 to 5 minutes residence time in flash drum 30 to yield a vapor phase effluent and a liquid phase effluent. Vapor phase effluent is withdrawn from flash drum 30 via conduit 32 under pressure control provided by pressure controller 34.

A liquid level is maintained in separator vessel 30 by means of level controller 38 positioned to regulate the flow of liquid phase effluent from flash drum 30 via conduit 36. Liquid phase effluent comprises significant amounts of catalyst and catalyst fines. Liquid phase effluent is withdrawn from a point is flash drum 30 which is relatively free of catalyst, such as adjacent the liquid level.

The liquid phase effluent withdrawn via conduit 36 is a minor portion of liquid phase effluent. The major portion of liquid phase effluent containing substantially all of the carried over catalyst and catalyst fines which have been allowed to settle, is withdrawn via conduit 35. It has been found advantageous to balance the volumetric ratio of the major proportion:minor proportion of first separation liquid at 10:1 to 1:1.

The liquid product of high pressure flash separation is withdrawn via line 36 and optionally cooled in heat exchanger 37 to a temperature below about 700° F. (371° C.), preferably 650° F. (343° C.) to 680° F. (360° C.). This cooled liquid is passed to intermediate pressure flash drum 40.

In flash drum 40 a flash separation is carried out at a pressure 250 to 1230 psi below the pressure in flash drum 30. This pressure is selected and maintained by means of pressure controller 44 in conduit 42. The vapor product of flash separation at this temperature and pressure is drawn off via conduit 42.

The vapor phase effluent of high pressure flash separation comprises a mixture of hydrogen, hydrogen sulfide, ammonia, light hydrocarbon gases and vaporized components of liquid fuel. This vapor phase effluent is first cooled to recover hydrocarbon components. Next, it is subjected to amine scrubbing to remove acid gases. The remaining vapor comprises hydrogen which is compressed and recycled to reactor vessel 20.

A liquid level is maintained in flash drum 40 by means of liquid level controller 48. This controls the flow of flash liquid through conduit 46. The flash liquid in conduit 46 is the hydrotreated product of the process. This product is most typically subjected to fractional distillation to yield distillate fuels such as gasoline, naphtha, kerosene and diesel oil and fuel oils such as gas oil and vacuum gas oil.

It is an essential feature of the ebullated bed process that a substantial amount of liquid be recycled to reactor vessel 20 in order to maintain the expansion of catalyst bed 21. A volumetric recycle rate of 1 to 10 times the feedstock rate provides a catalyst bed expansion of 110 vol % to 200 vol % of a settled catalyst bed volume. Settled catalyst bed density is generally in the range of 30 to 60 lb/ft$^3$. Catalyst bed expansion is achieved by the velocity of upward liquid flow in the order of 5 to 10 gallons per minute per square foot of horizontal reactor vessel cross-sectional area.

As mentioned, reactor vessel 20 contains an expanded catalyst bed 21 extending from lower end 21*a* to upper end 21*b*. The upper end 21*b* is defined by a catalyst bed level, detected by level indicator and controller 24. One means for detecting bed level is a nuclear gamma radiation source and detector shown, by way of example, in U.S. Pat. No. 4,750,989 to D. J. Soderberg, incorporated herein by reference.

Level indicator and controller 24 provides a set point signal to flow rate indicator and controller 54 regulating flow through recycle conduit 52. Flow rate indicator and controller 54 provides flow rate control of ebullation liquid to reactor vessel 20 to expand catalyst bed 21 to the required 110 vol % to 200 vol % of a settled catalyst bed volume.

Ebullation liquid is comprised of both flash separation liquid from flash drum 30 and flash separation liquid from flash drum 40. The invention relies on a new method of providing the ebullation liquid.

Intermediate pressure flash separation liquid from flash drum 40 is passed via conduit 45 to the suction of centrifugal pump 50. In centrifugal pump 50 a motive pressure differential is applied to provide a discharge pressure in conduit 52 of 10 to 100 psi above the reaction pressure in reaction vessel 20. Intermediate pressure flash separation liquid is passed as the motive fluid through eductor 60. The internal pressure in this liquid is used to educt high pressure flash separation liquid from flash drum 30, via conduit 35 into eductor 60. The resulting mixture of intermediate pressure flash separation liquid and high pressure flash separation liquid is the ebullation liquid.

As previously mentioned, the flow rate of ebullation liquid is set by flow rate controller 54. The proportion of the two components in ebullation liquid is determined by setting flow rate controller 64 in bypass conduit 66. Intermediate flash separation liquid in conduit 35 comprises amounts of catalyst and catalyst fines from reactor vessel 20. As previously explained that intermediate flash separation liquid in conduit 36 is decanted from flash drum 30 to substantially eliminate catalyst and catalyst fines carry over into flash drum 40. Consistent with the management of catalyst and particularly catalyst fines, flow rate controller 64 may be adjusted to reset the relative proportion of the two components of ebullation liquid. Also, eductor 60 is representative of a number of parallel eductors. Eductors are characterized in a narrow operating range. This is overcome by varying the number of eductors with demand. Bypass conduit 66 and flow controller 64 provide recycle of ebullation liquid for additional control to satisfy minimum flow requirements through eductor 60. In general, it has been found advantageous to adjust flow rate controller 64 to achieve a volumetric ratio in the ebullation liquid of major proportion of first separation liquid (line 35): second separation liquid of 10:1 to 1:1.

Eductors are a means for converting a static pressure head to kinetic energy. Their function is described by Daniel Bernoulli's theorem. A motive fluid at elevated pressure is passed through a venturi nozzle subjecting it to a velocity increase. As a result, the fluid experiences a drop in internal pressure. The venturi nozzle is configured so that the pressure drop causes suction to be drawn on a chamber containing a static fluid. The static fluid is entrained into the motive fluid and the two are discharged together from the eductor body.

The design of eductors is well-known in the art. For example, design is fully described in *Perry's Chemical Engineers' Handbook,* 4th ed., pp. 6–13 to 6–32 incorporated herein by reference.

This invention is shown by way of Example.

EXAMPLE

An ebullated bed process is operated as shown in the Drawing. Feedstock is a gas oil. High pressure flash separation is at reactor pressure and intermediate pressure flash separation is at 150 psig.

The design equations for an eductor are expressed as follows:

$$\text{Head Ratio } R_H = \frac{P_1 - P_s}{P_2 - P_s} \times \frac{SG_2}{SG_1}$$

$$\text{Weight Ratio } R_W = E_R\,(R_H)^{0.5} - 1 = \frac{W_s}{W_1}$$

$$\text{Volume Ratio } R_Q = R_w \times \frac{SG_1}{SG_s} = \frac{Q_s}{Q_1}$$

where:

NOMENCLATURE

| | Motive Fluid | Suction Fluid | Discharge Fluid |
|---|---|---|---|
| Pressure | $P_1$ | $P_s$ | $P_2$ |
| Volumetric Flow Rate | $Q_1$ | $Q_s$ | $Q_2$ |
| Weight Flow Rate | $W_1$ | $W_s$ | $W_2$ |
| Specific Gravity | $SG_1$ | $SG_s$ | $SG_2$ |

Eductor Efficiency Factor $E_R$

| | |
|---|---|
| $Q_1$ | 2000 gallons/minute |
| $Q_s$ | 6000 gallons/minute |
| $P_2$ | 1250 psig |
| $P_s$ | 1200 psig |
| $SG_1$ | 0.78 |
| $SG_s$ | 0.66 |
| $SG_2$ | 0.69 |
| $R_Q$ | 3 |
| $R_W$ | 2.5 |
| $R_H$ | 20 |
| $P_1$ | 2000 psig |

It is calculated that the feedstock pump would have to produce a $P_1$ pressure of 2000 psig and would require a motor having 2800 horsepower to ebullate the bed to 110 vol % to 200 vol % of settled catalyst volume. A separate recycle pump or ebullation pump is not required.

The replacement of the ebullation pump with an eductor significantly reduces investment cost of building a process unit. Due to the high suction pressure, the ebullation pump is very expensive due to support systems, including a variable speed drive system and a high pressure seal oil system. The maintenance cost is very high. In contrast, an eductor has no moving parts and maintenance cost is significantly lower.

While particular embodiments of the invention have been described, it will be understood, of course, that the invention is not limited thereto since many modifications may be made, and it is, therefore, contemplated to cover by the appended claims any such modification as fall within the true spirit and scope of the invention. For example, separations internal to the reactor vessel as well as in separation vessels external to the reactor vessel are contemplated.

What is claimed is:

1. An ebullated bed hydroprocessing process comprising:

passing a liquid hydrocarbon feedstock upwardly from a lower end to an upper end of an expanded catalyst bed at reaction temperature and reaction pressure to produce a reactor effluent;

flash separating the reactor effluent at a first separation pressure 0 to 50 psi below the reaction pressure to produce a first separation vapor and a first separation liquid;

dividing the first separation liquid into a major portion and a minor portion;

flash separating the minor portion of first separation liquid at a second separation pressure 250 to 1230 psi below the first separation pressure to produce a second separation vapor and a second separation liquid;

applying a motive pressure 10 to 100 psi above the reaction pressure to the second separation liquid and educting the major portion of first separation liquid therewith to form an ebullation liquid;

passing the ebullation liquid to the lower end of the expanded catalyst bed in an amount to maintain an expanded catalyst bed volume of 110 vol % to 200 vol % of a settled catalyst bed volume.

2. The process of claim 1 wherein the reaction pressure is 300 psia (20.4 atm) to 5000 psia (341 atm).

3. The process of claim 1 wherein the reaction pressure is 1200 psia (80 atm) to 3200 psia (217 atm).

4. The process of claim 1 wherein the volumetric ratio of major portion of first separation liquid:minor portion of first separation liquid is 10:1 to 1:1.

5. The process of claim 1 wherein in the ebullation liquid the volumetric ratio of major portion of first separation liquid:second separation liquid is 10:1 to 1:1.

* * * * *